US010739065B2

(12) United States Patent
Schenkl et al.

(10) Patent No.: US 10,739,065 B2
(45) Date of Patent: Aug. 11, 2020

(54) DOMESTIC REFRIGERATOR HAVING A WALL LIGHTING MODULE

(71) Applicant: emz-Hanauer GmbH & Co. KGaA, Nabburg (DE)

(72) Inventors: Johann Schenkl, Bodenwoehr (DE); Manfredi Signorino, Wackersdorf (DE); Martin Brabec, Nabburg (DE); Georg Wilhelm, Guteneck (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 0 days.

(21) Appl. No.: 16/223,238

(22) Filed: Dec. 18, 2018

(65) Prior Publication Data

US 2019/0195553 A1 Jun. 27, 2019

(30) Foreign Application Priority Data

Dec. 19, 2017 (DE) ..... 10 2017 011 926

(51) Int. Cl.

| | |
|---|---|
| ***F25D 27/00*** | (2006.01) |
| ***F21V 7/22*** | (2018.01) |
| ***F21V 7/00*** | (2006.01) |
| ***F21Y 115/10*** | (2016.01) |
| ***F21V 21/04*** | (2006.01) |
| ***F21W 131/305*** | (2006.01) |

(52) U.S. Cl.

CPC ..... *F25D 27/00* (2013.01); *F21V 7/0008* (2013.01); *F21V 7/22* (2013.01); *F21V 21/045* (2013.01); *F21W 2131/305* (2013.01); *F21Y 2115/10* (2016.08)

(58) Field of Classification Search

None

See application file for complete search history.

(56) References Cited

U.S. PATENT DOCUMENTS

| | | | |
|---|---|---|---|
| 2008/0007945 | A1 | 1/2008 | Kelly et al. |
| 2008/0204888 | A1 | 8/2008 | Kan et al. |
| 2010/0157607 | A1 | 6/2010 | Venhaus |

(Continued)

FOREIGN PATENT DOCUMENTS

| | | | |
|---|---|---|---|
| DE | 102013004042 | A1 | 9/2014 |
| JP | 2005302988 | A | 10/2005 |

(Continued)

*Primary Examiner* — Ashok Patel

(74) *Attorney, Agent, or Firm* — Sarita L. Pickett; Robert Deleault

(57) ABSTRACT

A domestic refrigerator has a cold chamber delimited by walls, and a lighting module inserted into a wall opening of a delimiting wall of the cold chamber. The lighting module has a planar, transparent light outlet pane arranged parallel to the delimiting wall, a frame inserted into the wall opening, at least one light-emitting diode which, in a projection perpendicular to the pane plane of the light outlet pane, is arranged so that it is concealed, and a light reflection surface, arranged behind the light outlet pane and irradiated by the light-emitting diode where the light reflection surface, in a region that is visible through the light outlet pane when viewed perpendicularly to the pane plane, has all over a roughness depth Rz of between 2.5 μm and 8.0 μm and an arithmetical mean roughness value Ra of between 0.63 μm and 2.4 μm.

13 Claims, 3 Drawing Sheets

(56) References Cited

U.S. PATENT DOCUMENTS

| | | | | |
|---|---|---|---|---|
| 2011/0038171 | A1 | 2/2011 | Uchida | |
| 2012/0268962 | A1 | 10/2012 | Uchida | |
| 2017/0131024 | A1* | 5/2017 | Kempfle | F25D 23/066 |
| 2017/0167714 | A1* | 6/2017 | Hong | F21V 29/83 |
| 2018/0335188 | A1* | 11/2018 | Di Trapani | F21S 8/006 |

FOREIGN PATENT DOCUMENTS

| | | | |
|---|---|---|---|
| JP | 2007132562 | A | 5/2007 |
| JP | 2008051366 | A | 3/2008 |
| JP | 2011163668 | A | 8/2011 |

* cited by examiner

DOMESTIC REFRIGERATOR HAVING A WALL LIGHTING MODULE

BACKGROUND OF THE INVENTION

1. Field of the Invention

The present invention relates generally to a domestic refrigerator having a wall lighting module which is fitted into a wall surface of a cold chamber of the refrigerator.

2. Description of the Prior Art

Domestic refrigerators frequently have one or more lighting devices by means of which the interior of the refrigerator, which serves to keep foods cold, is illuminated when the door is open so that a user is better able to see the foods stored therein. For aesthetic reasons, suitable lighting modules are sometimes fitted into a (e.g. side or back) delimiting wall of the cold chamber, so that the user perceives the lighting module as an integral part of the wall surface. Because of their luminous power and working life, light-emitting diodes have become increasingly important as the type of light source used in lighting devices for domestic refrigerators. However, the fact that the luminous power of light-emitting diodes is concentrated at a point can give rise to the problem that the user perceives the brightness as being unevenly distributed over the light outlet surface of the lighting module.

SUMMARY OF THE INVENTION

Accordingly, it is an object of the invention to provide a domestic refrigerator equipped with a wall lighting module in which a good luminous intensity of the lighting module can be achieved with as homogeneous as possible a distribution of the brightness.

In order to achieve that object there is provided according to the invention a domestic refrigerator having a cold chamber delimited by walls, and at least one lighting module inserted into a wall opening of a delimiting wall of the cold chamber. The lighting module includes a planar, transparent light outlet pane arranged parallel to the delimiting wall and having a transmittance of not less than 90% in the visible spectrum; a frame, inserted into the wall opening, for holding the light outlet pane, wherein the frame, on the side of the delimiting wall facing the cold chamber, overlaps the opening edge all around the wall opening and the light outlet pane is inserted into the frame inside the contour of the wall opening, wherein the light outlet pane, on its pane side remote from the cold chamber, rests along its pane periphery on a support shoulder formed by the frame; a light source arrangement having at least one light-emitting diode, wherein, in a projection perpendicular to the pane plane of the light outlet pane, each light-emitting diode of the light source arrangement is arranged so that it is concealed; and a light reflection surface, arranged behind the light outlet pane and irradiated by each light-emitting diode of the light source arrangement, for reflecting light in the direction towards the light outlet pane, wherein the light reflection surface, in a region that is visible through the light outlet pane when viewed perpendicularly to the pane plane, has all over a roughness depth Rz of not less than 2.5 μm and not more than 8.0 μm and an arithmetical mean roughness value Ra of not less than 0.63 μm and not more than 2.4 μm. In some embodiments, the roughness depth Rz of the light reflection surface is not less than 3.0 μm and not more than 6.5 μm, while the arithmetical mean roughness value Ra is not less than 0.8 μm and not more than 2.0 μm.

Owing to the high transmittance of the light outlet pane of at least 90% and in some embodiments of at least 93% or even at least 95%, losses in luminous intensity, as would be feared, for example, in the case of a satinised or milky form of the light outlet pane, can be avoided. At the same time, the roughness of the light reflection surface with the indicated numerical values of the roughness depth Rz and the arithmetical mean roughness value Ra ensure good homogeneity of the brightness distribution which a user perceives when he looks at the light outlet pane. In the solution according to the invention, the light reflection surface is not a high gloss polished surface and can be adjusted to the desired roughness by an electrical discharge machining process, for example. Where mention is made in the context of the present disclosure of the roughness depth Rz, it is understood as being the mean roughness depth Rz defined in standard DIN EN ISO 4287, while the arithmetical mean roughness value Ra means the corresponding parameter defined in the same standard. With the indicated numerical values of the roughness depth Rz and the arithmetical mean roughness value Ra, the light reflection surface has a diffusely reflecting action and in particular acts almost in the manner of a Lambertian radiator. This property of the light reflection surface ensures sufficient homogenisation of the brightness distribution on the light outlet side of the light outlet pane. Moreover, the concealed arrangement of each light-emitting diode of the light source arrangement makes it possible to prevent the user from looking directly at the light-emitting diode(s) when he looks at the light outlet pane perpendicularly, and a visually perceptible inhomogeneity in the brightness distribution can thus be avoided.

In some embodiments, the frame has holding structures by means of which it can be clamped between mutually opposite edge regions of the wall opening, wherein the holding structures comprise at least one resiliently deflectable clamping tongue which in a tongue end region has a stepped profile with a plurality of steps, wherein the clamping tongue is in clamping engagement with the delimiting wall at only one of the steps. The different steps of the stepped profile permit adaptation to different thicknesses of the delimiting wall, that is to say the clamping tongue can be in clamping engagement with the delimiting wall at a different step according to the wall thickness of the delimiting wall. It is then not necessary to manufacture a different model of the frame for different refrigerator models which differ by a different wall thickness of the delimiting wall. Instead, a universal frame which is compatible with different thicknesses of the delimiting wall can be provided.

In some embodiments, the frame is equipped with holding structures for holding the lighting module on the delimiting wall, wherein the holding structures permit an insertion movement, oriented transversely to the wall plane of the delimiting wall, of the lighting module into the wall opening, followed by a locking movement, oriented parallel to the wall plane of the delimiting wall, of the lighting module. The holding structures can thereby comprise at least one resiliently deflectable pressing element which passes through the wall opening during the insertion movement of the lighting module and moves under the delimiting wall during the locking movement of the lighting module. The pressing element can delimit a clamping slot into which the delimiting wall moves during the locking movement of the lighting module. For example, the pressing element is formed by a spring leaf which is clamped at both ends. The lighting module can be adapted to different thicknesses of the delimiting wall also in the case of the embodiments that comprise a resiliently deflectable pressing element, namely by deflecting the pressing element to different degrees.

In some embodiments, the light reflection surface and at least a portion of the support shoulder are formed by a common white plastics injection-moulded body. In some embodiments, this white plastics injection-moulded body can form the entire frame including a frame region which protrudes from the opening edge of the wall opening on the side of the delimiting wall facing the cold chamber. In other embodiments, the frame can comprise a frame part extending all round the light outlet pane, which frame part is of a contrasting colour to the white plastics injection-moulded body and protrudes from the opening edge of the wall opening on the side of the delimiting wall facing the cold chamber. By means of such a frame part, which forms a separate component from the white injection-moulded body, a particularly elegant form of the lighting module can be achieved with a suitable colour choice.

In some embodiments, each light-emitting diode of the light source arrangement is arranged with its main beam axis at such an angle to the pane plane of the light outlet pane that all the light of the light-emitting diode in question that is transmitted through the light outlet pane undergoes an at least one-time reflection at the light reflection surface beforehand, where the light reflection surface, when viewed in a section normal to the pane plane and containing the main beam axis of the light-emitting diode, extends at least in part in a curved manner between a first end region, which is situated closer to the light-emitting diode and further away from the light outlet pane, and a second end region, which is situated further away from the light-emitting diode and closer to the light outlet pane.

The present invention additionally provides a group of domestic refrigerators in which the frame of the lighting module in each case has holding structures by means of which the frame can be clamped between mutually opposite edge regions of the wall opening, where the holding structures include at least one resiliently deflectable clamping tongue which in a tongue end region has a stepped profile with a plurality of steps, wherein the clamping tongue is in clamping engagement with the delimiting wall at only one of the steps. The domestic refrigerators of the group differ from one another by a different wall thickness of the delimiting wall in the region of the wall opening, where in each of the domestic refrigerators of the group, the clamping tongue is in clamping engagement with the delimiting wall at a different step of the stepped profile.

The invention will be explained in greater detail below with reference to the accompanying drawings.

DETAILED DESCRIPTION OF THE INVENTION

Figure 1:
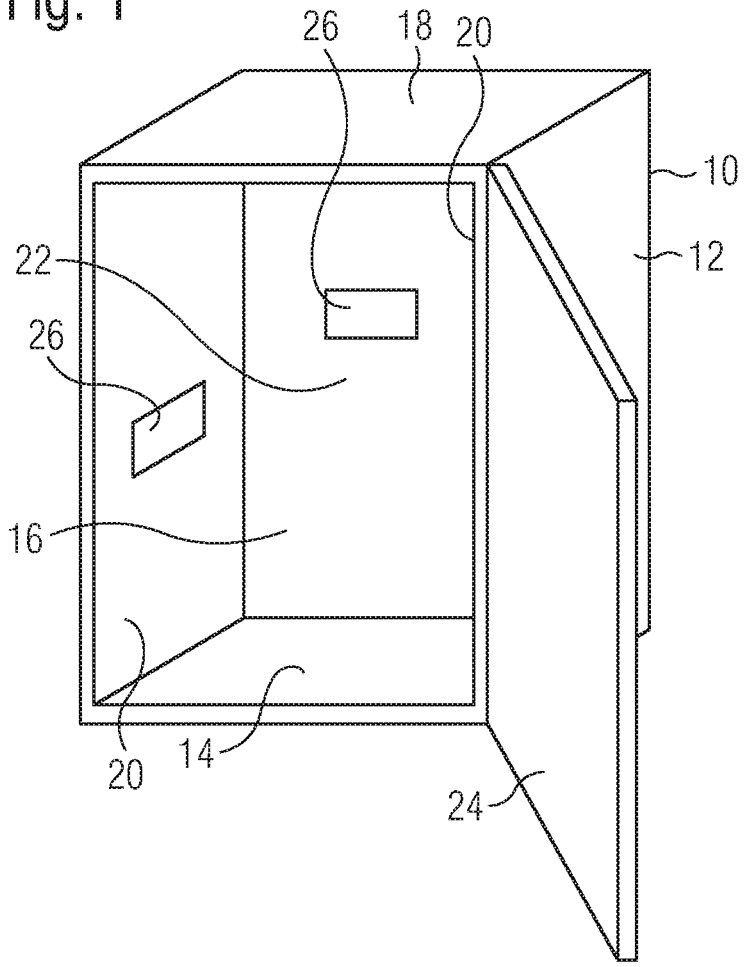
FIG. 1 is a highly diagrammatic representation of a domestic refrigerator with fitted wall lighting modules.

Reference will first be made to FIG. 1. The domestic refrigerator shown therein is generally designated 10. It comprises a body 12 having a bottom wall 14, a rear wall 16, a top wall 18 and two mutually opposite side walls 20, which together delimit an interior 22 of the refrigerator 10. The interior 22 forms the cold chamber in which the foods to be stored are kept. To that end, it is equipped, in a manner which is not shown in greater detail but is generally known, with one or more shelves and/or one or more drawers on/into which the foods can be placed/introduced. In the example shown in FIG. 1, a door 24 is articulated with the body 12, by means of which door the cold chamber 22 can be closed.

When the door 24 is open (as is shown in FIG. 1), it is desirable to light the cold chamber 22 artificially in order to give the user a better view of the foods located therein. To that end there is fitted into at least one of the walls 14, 16, 18, 20 at least one wall lighting module 26, which is so controlled, for example, that it is switched on or off in dependence on the opening and closing of the door 24. In the example shown, a wall lighting module 26 is fitted into the rear wall 16, a further wall lighting module 26 is fitted into the side wall 20 shown on the left in FIG. 1. It will be appreciated that the distribution pattern of the wall lighting modules 26 shown in FIG. 1 is given purely by way of example and can be changed as desired as regards both the number and the position of the wall lighting modules 26. It will additionally be appreciated that the wall lighting modules 26 do not have to be the only lighting means with which the refrigerator 10 is equipped. In addition to the wall lighting modules 26, lighting means of other forms can be provided. Such lighting means of other forms are not subject matter of the present disclosure and do not require further explanation.

Figure 2:
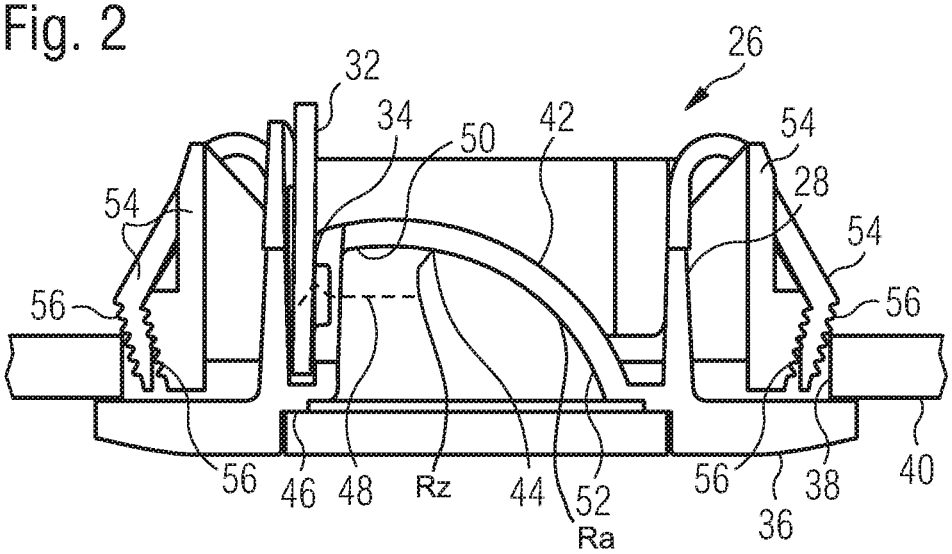
FIG. 2 is a sectional view of a wall lighting module of the refrigerator of FIG. 1 according to a first exemplary embodiment.

At least one of the wall lighting modules 26 can have the form shown in FIG. 2. In this form, the wall lighting module 26 in question comprises a module housing 28, a light outlet pane 30, and a circuit board 32 with a plurality of light-emitting diodes 34 arranged thereon one behind the other in a row. The housing module 28 forms a frame 36 having, for example, an approximately square or rectangular contour, which is inserted into an opening 38 in a delimiting wall 40. The delimiting wall 40 is one of the walls of the body 12 that delimit the cold chamber 22. For example, the delimiting wall 40 is part of the rear wall 16 or part of one of the side walls 20 or part of the top wall 18. The module housing 28 further forms a reflection body 42 which has a diffusely reflecting light reflection surface 44. From the point of view of the observer, the light reflection surface 44 is arranged behind the light outlet pane 30. The light outlet pane 30 is in turn inserted into the frame 36, where it rests on a support shoulder 46 which is set back relative to the front side of the frame and extends all around the light reflection surface 44, forming a support surface on which the light outlet pane 30 rests continuously along its entire pane periphery. In the region of the support shoulder 46, the light outlet pane 30 is fastened to the frame 36, welding by an ultrasonic welding process being particularly suitable. Alternatively, adhesive bonding of the light outlet pane 30 with the frame 36 is conceivable.

The light outlet pane 30 is set flush into the frame 36, so that the pane front side of the light outlet pane 30 facing the cold chamber 22 of the refrigerator 10 merges substantially continuously into the adjoining regions of the frame front side of the frame 36. It will be seen in FIG. 2 that the frame 36 extends beyond the edge of the opening 38 and overlaps a region of the delimiting wall 40 adjacent to the opening edge. This is the case all around the opening 38, so that the opening 38 is concealed completely from an observer looking at the lighting module 26 from the cold chamber 22. The light outlet pane 30 has a smaller extent than the opening 38 and, in a notional projection perpendicular to the pane plane of the light outlet pane 30, is situated wholly inside the contour of the opening 38. It is in the form of a clear pane with a transmittance of not less than 90% in the visible spectrum. For example, it has a transmittance of 95% or even more. Glass or a sufficiently transparent plastics material are suitable as the material for the light outlet pane 30.

Each light-emitting diode 34 is arranged so that it is concealed by the module housing 28, such that an observer, when looking perpendicularly to the pane plane of the light outlet pane 30, does not have a direct view of the light-emitting diodes 34. In the example shown, the light-emitting diodes 34 are arranged with their main beam axis (denoted 48) substantially parallel to the pane plane of the light outlet pane 30. The main beam axis 48 is the axis on which the emission pattern of the light-emitting diode 34 in question has the greatest radiation intensity. Typically, the emission pattern of each light-emitting diode 34 has a main lobe with an opening angle of, for example, more than 90° or more than 120° or more than 150°, it being possible in some circumstances for one or more side lobes additionally to be present. In other embodiments, the circuit board 32 can be at an angle relative to the pane plane of the light outlet pane 30, namely in such a manner that the main beam axis 48 of each of the light-emitting diodes 34 slopes away from the light outlet pane 30.

When seen in the sectional plane of FIG. 2, the light reflection surface 44 extends curved in an arcuate manner between a first end region 50 and a second end region 52. The first end region 50 is closer to the circuit board 32 than the second end region 52, which is further away from the circuit board 32 and thus further away from the light-emitting diodes 34. At the same time, the light reflection surface 44 is at a greater distance from the light outlet pane 30 in its first end region 50 than in its second end region 52. The profile of the light reflection surface 44 between the first end region 50 and the second end region 52 can follow, for example, a parabola or a spline or any desired conical curve in general. Moreover, the possibility that the light reflection surface 44 is in part in linear form in its profile from the first end region 50 to the second end region 52 is not ruled out.

In a region in which the light reflection surface 44 is visible when viewed perpendicularly through the light outlet pane 30, the light reflection surface 44 has a roughness depth Rz according to DIN EN ISO 4287 in a range between 2.5 μm and 8.0 μm, preferably between 3.0 μm and 6.5 μm. The arithmetical mean roughness value Ra according to the same DIN EN ISO standard is, in the case of those Rz values, in a range between 0.63 μm and approximately 2.4 μm, preferably between 0.8 μm and 2.0 μm. If these values of Rz and Ra are expressed on the basis of the reference classes defined in guideline VDI 3400 (VDI: Verein Deutscher Ingenieure [association of German engineers]), the roughness of the light outlet pane 30 lies in a range between 16 and 28, preferably between 18 and 26 or 27. This ensures diffuse reflection of the light of the light-emitting diodes 34 at the light reflection surface 44 and good homogenisation of the brightness distribution at the surface of the light outlet pane 30 perceived by an observer. In the example of FIG. 2 that is shown, the module housing 28 with the reflector body 42 and the frame 36 is formed by a single component which can be produced by an injection-moulding process from a white plastics material. It will be appreciated that, as an alternative, the reflector body 42 and the frame 36 may be injection-moulded components produced separately. In order to establish the desired values of the roughness parameters Rz and Ra of the light reflection surface 44, an injection mould with which an injection-moulded body forming the light reflection surface 44 is produced can be pre-treated, for example by an electrical discharge machining process or an etching process, in a region of the mould surface corresponding to the light reflection surface 44. With this procedure, the desired roughness profile is accordingly introduced into the injection mould (negative). Instead of machining the injection mould, it is conceivable to after-treat the finished injection-moulded part in the region of the light reflection surface 44 in order to produce the desired roughness profile, for example by micro-embossing. For the observer of the lighting module 26 there is obtained a consistently white appearance which also includes the light reflection surface 44 and, owing to the clarity, that is to say the high transmittance, of the light outlet pane 30, is not impaired by the light outlet pane.

In the exemplary embodiment shown in FIG. 2, the frame 36 has holding structures in the form of a plurality of resiliently deflectable clamping tongues 54, by means of which the frame can be clamped between mutually opposite edge regions of the opening 38. In the case of a form of the frame 36 with an approximately square or rectangular contour, one or more clamping tongues 54 can be formed, for example, on each of two mutually opposite square or rectangle sides of the frame 36. In other forms, it may be sufficient for one or more clamping tongues 54 to be formed on only one square or rectangle side of the frame 36. In the example shown in FIG. 2, the clamping tongues 54 each have in the region of a free tongue end a stepped profile 56 with a plurality of steps, one of which comes into engagement with the delimiting wall 40 when the lighting module 26 is mounted. The steps of the stepped profile 56 may be in the form of rectangular steps; alternatively, the stepped profile 56 can resemble more of an undulating profile or a saw-tooth profile. The exact form of the individual steps of the stepped profile 56 can be freely chosen. When the frame 36 is inserted into the opening 38 of the delimiting wall 40, the clamping tongues 54 are deflected slightly from their rest position in the direction towards the lighting module 26. As a result, an internal stress builds up in the clamping tongues 54, which causes the lighting module 26 to be braced between mutually opposite edge regions of the opening 38. Depending on the thickness of the delimiting wall 40, the edge of the opening 38 situated on the side of the delimiting wall 40 that is remote from the cold chamber engages into a different step of the stepped profile 56. The clamping tongues 54 are thus compatible with different thicknesses of the delimiting wall 40. The engagement of the edge of the opening 38 that is remote from the cold chamber into the stepped profile 56 at the same time causes the lighting module 26 to be fixed in a direction perpendicular to the plane of the opening 38, that is to say the steps of the stepped profile 56 act like a barb which prevents the lighting module 26 from being pulled out of the opening 38.

In the further figures, components which are the same or have the same effect are provided with the same reference numerals as before, but with the addition of a lowercase letter. Unless indicated otherwise hereinbelow, reference is made for the explanation of such components to the above observations in relation to FIGS. 1 and 2.

Figure 3:
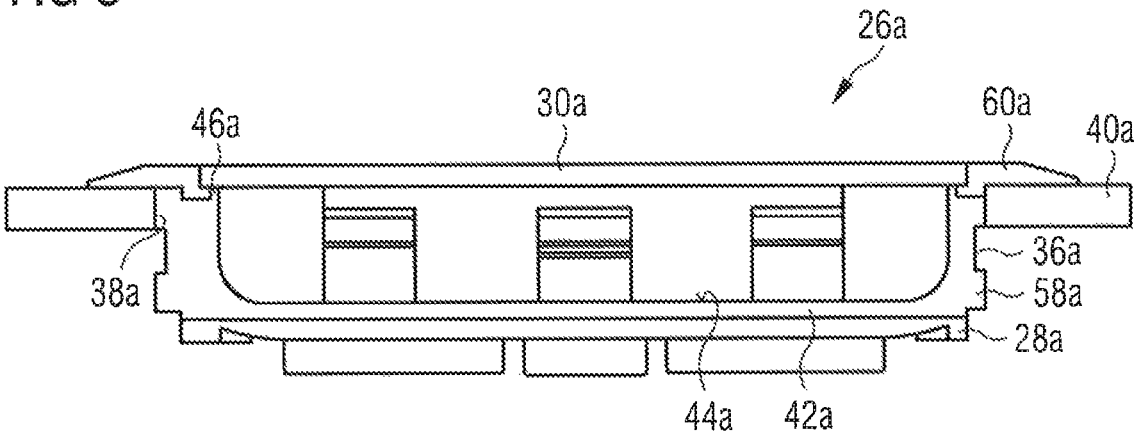
FIG. 3 is a sectional view of a wall lighting module according to a second exemplary embodiment.

In the lighting module **26*a* shown in FIG. 3, which is shown in a section along a plane which is orthogonal to the sectional plane of FIG. 2, the frame 36*a* comprises a frame base body 58*a* which forms an inner part of the support shoulder 46*a* and is produced integrally with the reflector body 42*a* as a white injection-moulded body, and a frame part 60***a*, separate from that white injection-moulded body, which encloses the light outlet pane 30*a* and forms an outer part of the support shoulder 46*a*. The frame part 60*a* forms the exposed frame front side of the frame 36*a* which is directly visible to the observer and can be of a different colour than the white injection-moulded body forming the frame main body 58*a* and the reflector body 42*a*. The light outlet pane 30*a* is fastened to the frame 36*a* at least in the region of the part of the support shoulder 46*a* that is formed by the frame main body 58*a*. If desired, an additional welded or adhesive connection can be produced between the light outlet pane 30*a* and the frame part 60*a*.

Figure 4A:
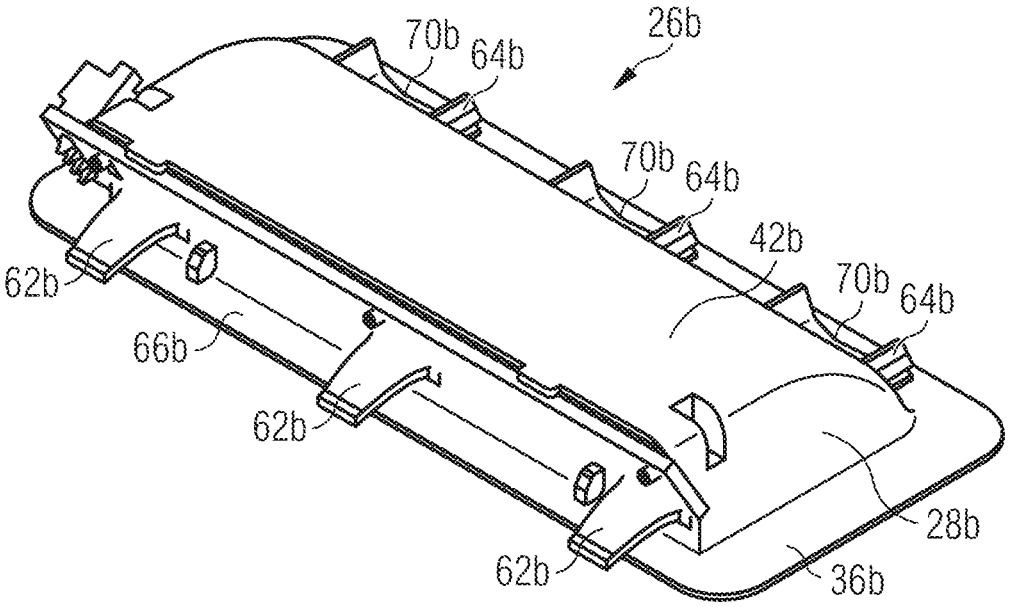
FIG. 4*a* is a rear perspective view of a wall lighting module according to a third exemplary embodiment.
Figure 4B:
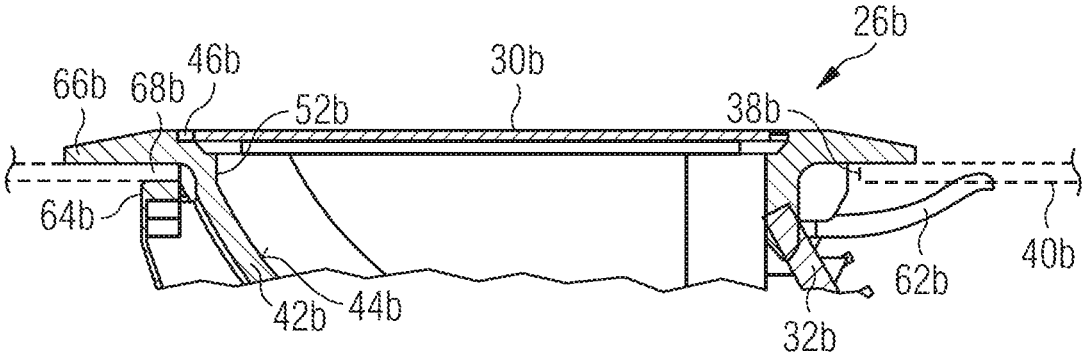
FIG. 4*b* is a sectional view of the wall lighting module according to FIG. 4*a*.

In the embodiment according to FIGS. 4*a* and 4*b*, resiliently deflectable clamping elements 62*b*, 64*b* are provided for holding the frame 36*b* on the delimiting wall 40*b*, which clamping elements clamp the delimiting wall 40*b* between themselves and a frame front part 66*b* which extends all around the light outlet pane 30*b* and forms the exposed front side of the frame 36*b*. Both the clamping elements 62*b* and the clamping elements 64*b* can each be present singly or in a plurality; in the example shown in FIG. 4*a*, a total of three clamping elements 62*b* are formed on one rectangle side of the frame 36*b*, while a total of three clamping elements 64*b* are formed on the opposite rectangle side of the frame 36*b*. The clamping elements 62*b*, 64*b* are produced integrally with the frame 36*b*.

In the example shown, the clamping elements 62*b* are in the form of spring tongues which protrude with their free tongue ends from the frame front part 66*b*. When the frame 36*b* is fitted into the opening 38*b* of the delimiting wall 40*b*, the clamping elements 62*b* are first pushed behind the delimiting wall 40*b*, whereby the clamping elements 62*b* experience a certain deflection. As soon as the clamping elements 62*b* are engaged sufficiently far behind the delimiting wall 40*b*, the frame 36*b* can be pivoted fully into the opening 38*b*. The clamping elements 64*b* thereby pass through the opening 38*b*. As soon as the frame front part 66*b* is resting on the delimiting wall 40*b* on all sides, this insertion movement of the lighting module 26*b* oriented transversely to the wall plane of the delimiting wall 40*b* is complete. Fitting is continued by a subsequent locking movement, which takes place without further pivoting of the frame 36*b* in the direction along the rectangle side on which the clamping elements 64*b* are formed. This locking movement is thus carried out while the frame front part 66*b* is resting on the delimiting wall 40*b* on all sides.

The clamping elements 64*b* form a clamping slot 68*b* between themselves and the bottom side of the frame front part 66*b*. The opening 38*b* is so shaped that, in association with each of the clamping elements 64*b*, it forms a wall web which, during the described locking movement of the frame 36*b*, moves into the clamping slot 68*b* of the associated clamping element 64*b*. In the example shown, the clamping elements 64*b* are each formed by a spring leaf or clip which is clamped in the region of its two clip ends and is elastically deflectable in the region of its clip middle portion 70*b*. The slot width of the clamping slot 68*b* is defined by the distance of the clip middle portion 70*b* from the bottom side of the frame front part 66*b*. During the locking movement, the wall web of the delimiting wall 40*b* associated with a respective clamping element 64*b* is clamped in the clamping slot 68*b* in question. The clip middle portion 70*b* of each clamping element 64*b* thereby presses the wall web in question against the frame front part 66*b*. The clamping elements 64*b* may therefore also be referred to as pressing elements.

Owing to the resilience of the clamping elements 62*b*, 64*b*, the exemplary embodiment according to FIGS. 4*a*, 4*b* is also suitable for different thicknesses of the delimiting wall 40*b*.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A domestic refrigerator having a cold chamber delimited by walls, and at least one lighting module inserted into a wall opening of a delimiting wall of the cold chamber, the at least one lighting module comprising:

a transparent light outlet pane, being arranged in a pane plane parallel to the delimiting wall, and having a transmittance of not less than 90% in a visible spectrum;

a frame, being inserted into the wall opening, for holding the light outlet pane, wherein the frame, on a side of the delimiting wall facing the cold chamber, overlaps an opening edge all around the wall opening and the light outlet pane is inserted into the frame inside a contour of the wall opening, wherein the light outlet pane, on a pane periphery along a pane side remote from the cold chamber, rests on a support shoulder formed by the frame;

a light source arrangement having at least one light-emitting diode, wherein, in a projection perpendicular to the pane plane of the light outlet pane, each light-emitting diode of the light source arrangement is arranged so that it is concealed; and a light reflection surface, being arranged behind the light outlet pane and irradiated by each light-emitting diode of the light source arrangement, for reflecting light in the direction towards the light outlet pane, wherein the light reflection surface, in a region that is visible through the light outlet pane when viewed perpendicularly to the pane plane, has all over a roughness depth Rz of not less than 2.5 μm and not more than 8.0 μm and an arithmetical mean roughness value Ra of not less than 0.63 μm and not more than 2.4 μm.

2. The domestic refrigerator according to claim 1, wherein the light outlet pane has a transmittance of not less than 93% or not less than 95% in the visible spectrum.

3. The domestic refrigerator according to claim 1, wherein the frame has holding structures by means of which it can be clamped between mutually opposite edge regions of the wall opening, wherein the holding structures comprise at least one resiliently deflectable clamping tongue which in a tongue end region has a stepped profile with a plurality of steps, wherein the clamping tongue is in clamping engagement with the delimiting wall at only one of the steps.

4. The domestic refrigerator according to claim 1, wherein the frame is equipped with holding structures for holding the lighting module on the delimiting wall, wherein the holding structures permit an insertion movement, oriented transversely to a wall plane of the delimiting wall, of the lighting module into the wall opening, followed by a locking movement, oriented parallel to the wall plane, of the lighting module.

5. The domestic refrigerator according to claim 4, wherein the holding structures comprise at least one resiliently deflectable pressing element which passes through the wall opening during the insertion movement of the lighting module and moves under the delimiting wall during the locking movement of the lighting module.

6. The domestic refrigerator according to claim 5, wherein the pressing element delimits a clamping slot into which the delimiting wall moves during the locking movement of the lighting module.

7. The domestic refrigerator according to claim 6, wherein the pressing element is formed by a spring leaf which is clamped at both ends.

8. The domestic refrigerator according to claim 1, wherein the light reflection surface and at least a portion of the support shoulder are formed by a common white plastics injection-moulded body.

9. The domestic refrigerator according to claim 8, wherein the light outlet pane is welded to the white plastics injection-moulded body all round in the region of the support shoulder, in particular by ultrasonic welding.

10. The domestic refrigerator according to claim 8, wherein the frame comprises a frame part produced separately from the white plastics injection-moulded body and extending all round the light outlet pane, which frame part is of a contrasting colour to the white plastics injection-moulded body and protrudes from the opening edge of the wall opening on the side of the delimiting wall facing the cold chamber.

11. The domestic refrigerator according to claim 1, wherein each light-emitting diode of the light source arrangement is arranged with its main beam axis at such an angle to the pane plane of the light outlet pane that all the light of the light-emitting diode in question that is transmitted through the light outlet pane undergoes an at least one-time reflection at the light reflection surface beforehand, wherein the light reflection surface, when viewed in a section normal to the pane plane and containing the main beam axis of the light-emitting diode, extends at least in part in a curved manner between a first end region, which is situated closer to the light-emitting diode and further away from the light outlet pane, and a second end region, which is situated further away from the light-emitting diode and closer to the light outlet pane.

12. The domestic refrigerator according to claim 1, wherein the roughness depth Rz of the light reflection surface is not less than 3.0 μm and not more than 6.5 μm and the arithmetical mean roughness value Ra is not less than 0.8 μm and not more than 2.0 μm.

13. A group of domestic refrigerators each having the form according to claim 3, wherein the domestic refrigerators of the group differ from one another by a different wall thickness of the delimiting wall in the region of the wall opening, wherein in each of the domestic refrigerators of the group the clamping tongue is in clamping engagement with the delimiting wall at a different step of the stepped profile.

* * * * *